US009543676B2

(12) United States Patent
Evans et al.

(10) Patent No.: US 9,543,676 B2
(45) Date of Patent: Jan. 10, 2017

(54) CONNECTOR ADAPTER AND CIRCUIT BOARD ASSEMBLY INCLUDING THE SAME

(71) Applicant: Tyco Electronics Corporation, Berwyn, PA (US)

(72) Inventors: Nicholas Lee Evans, Harrisburg, PA (US); Christopher David Ritter, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/624,176

(22) Filed: Feb. 17, 2015

(65) Prior Publication Data

US 2016/0240946 A1 Aug. 18, 2016

(51) Int. Cl.
*H01R 12/72* (2011.01)

(52) U.S. Cl.
CPC ..... *H01R 12/721* (2013.01)

(58) Field of Classification Search
CPC ... H01R 12/721; H01R 12/724; H01R 12/727; H01R 12/737; H01R 13/6587; H01R 13/648; H01R 23/688; H01R 12/716; H01R 13/6658
USPC ..... 439/78, 82, 637, 607.05, 607.07, 541.5, 439/74, 607.27, 607.09, 607.11
See application file for complete search history.

(56) References Cited

U.S. PATENT DOCUMENTS

| | | | | |
|---|---|---|---|---|
| 4,269,468 | A * | 5/1981 | Ammon | H01R 12/58 439/637 |
| 7,381,092 | B2 * | 6/2008 | Nakada | H01R 13/514 439/607.1 |
| 7,985,079 | B1 | 7/2011 | Wilson et al. | |
| 9,017,103 | B2 * | 4/2015 | Davis | H01R 23/688 439/607.05 |
| 2012/0184136 | A1 * | 7/2012 | Ritter | H01R 12/724 439/607.01 |

* cited by examiner

*Primary Examiner* — Abdullah Riyami
*Assistant Examiner* — Harshad Patel

(57) ABSTRACT

Connector adapter includes an adapter body having a mating side and a mounting side. The mating side includes signal cavities that open to the mating side. The connector adapter also includes signal conductors extending through the adapter body. Each of the signal conductors has and extends between a pin socket positioned at the mating side and a signal tail positioned at the mounting side. The pin sockets are positioned within corresponding signal cavities. Each of the pin sockets includes first and second arms that oppose each other and define a thru-hole therebetween. The first and second arms engage a signal tail of an electrical connector when the signal tail of the electrical connector is inserted into the thru-hole.

19 Claims, 7 Drawing Sheets

CONNECTOR ADAPTER AND CIRCUIT BOARD ASSEMBLY INCLUDING THE SAME

BACKGROUND

The subject matter herein relates generally to electrical connectors that are configured to transmit data signals.

Communication systems, such as routers, servers, uninterruptible power supplies (UPSs), supercomputers, and other computing systems, may be complex systems that have a number of components interconnected to one another. For instance, a conventional backplane or midplane communication system includes several daughter card assemblies that are interconnected to a common backplane or midplane. The daughter card assemblies include a circuit board and a plurality of electrical connectors mounted to the circuit board. At least some of the electrical connectors are receptacle connectors that are positioned along a leading edge of the circuit board. The receptacle connectors are configured to mate with corresponding header connectors coupled to the backplane or midplane. The daughter card assemblies may also include other electrical and/or optical connectors, such as pluggable input/output (I/O) modules, that communicate with remote components.

As signal speeds and performance demands increase, enterprises have modified the conventional backplane and midplane communication systems. For example, modifications to the communication system may require that the receptacle connectors of the daughter card assembly be moved to higher elevations with respect to the circuit board. The receptacle connectors, however, are not adjustable for repositioning at a higher elevation. Instead of replacing the conventional receptacle connectors with different receptacle connectors, it may be more cost-effective to use a device that allows the system to utilize the conventional receptacle connectors.

Accordingly, a need exists for a device that allows an electrical connector to be positioned at a higher elevation relative to a circuit board.

BRIEF DESCRIPTION

In an embodiment, a connector adapter is provided that includes an adapter body having a mating side and a mounting side. The mounting side is configured to be mounted to a circuit board. The mating side is configured to have an electrical connector stacked thereon. The mating side includes signal cavities that open to the mating side. The connector adapter also includes signal conductors extending through the adapter body. Each of the signal conductors has and extends between a pin socket positioned at the mating side and a signal tail positioned at the mounting side. The pin sockets are positioned within corresponding signal cavities. Each of the pin sockets includes first and second arms that oppose each other and define a thru-hole therebetween. The first and second arms engage a signal tail of the electrical connector when the signal tail of the electrical connector is inserted into the thru-hole.

In an embodiment, an electrical connector assembly is provided that includes an electrical connector having a mounting side and a connector array of signal and ground tails positioned along the mounting side. The electrical connector has a mating side that is configured to mate with an electrical component. The electrical connector assembly also includes a connector adapter having an adapter body with a mating side that is configured to interface with the mounting side of the electrical connector. The mating side of the adapter body includes signal and ground cavities that open to the mating side of the adapter body. The connector adapter includes a conductor assembly having signal and ground conductors that extend through the adapter body. The signal conductors form a plurality of signal pairs. The ground conductors are positioned such that each of the signal pairs is surrounded by at least two of the ground conductors. The signal and ground conductors have signal and ground terminals, respectively, that are positioned within the signal and ground cavities, respectively, proximate to the mating side of the adapter body. The signal and ground terminals engage the signal and ground tails, respectively, of the connector array.

In an embodiment, a connector adapter is provided that includes an adapter body having a mating side and a mounting side. The mounting side is configured to be mounted to a circuit board. The mating side has signal and ground cavities that open to the mating side. The connector adapter also includes a conductor assembly having signal conductors and ground blades that extend from the mating side to the mounting side. The signal conductors form a plurality of signal pairs. The signal conductors and the ground blades have signal and ground terminals, respectively, that are positioned within the signal and ground cavities, respectively, proximate to the mating side. The ground blades are positioned such that each of the signal pairs is surrounded by corresponding ground blades, wherein at least two of the corresponding ground blades are oriented perpendicular to each other. The mating side is configured to interface with an electrical connector having signal and ground tails after a stacking operation in which the signal and ground tails advance into the signal and ground cavities. The signal terminals engage corresponding signal tails within the corresponding signal cavities, and the ground terminals engage corresponding ground tails within the corresponding ground cavities.

In an embodiment, a circuit board assembly is provided that includes an electrical connector having a mounting side and a connector array of signal and ground tails positioned along the mounting side. The electrical connector has a mating side that is configured to mate with an electrical component. The circuit board assembly also includes a circuit board having plated thru-holes (PTHs). The circuit board assembly also includes a connector adapter stacked between and communicatively coupling the electrical connector and the circuit board. The connector adapter includes an adapter body having a mating side that interfaces with the mounting side of the electrical connector. The mating side includes signal and ground cavities that open to the mating side. The connector adapter includes a conductor assembly having signal and ground conductors that extend through the adapter body. The signal conductors form a plurality of signal pairs. The ground conductors are positioned such that each of the signal pairs is surrounded by at least two ground conductors. The signal and ground conductors have signal and ground terminals, respectively, that are positioned within the signal and ground cavities, respectively, proximate to the mating side. The signal and ground terminals engage the signal and ground tails, respectively, of the connector array.

DETAILED DESCRIPTION

Figure 1:
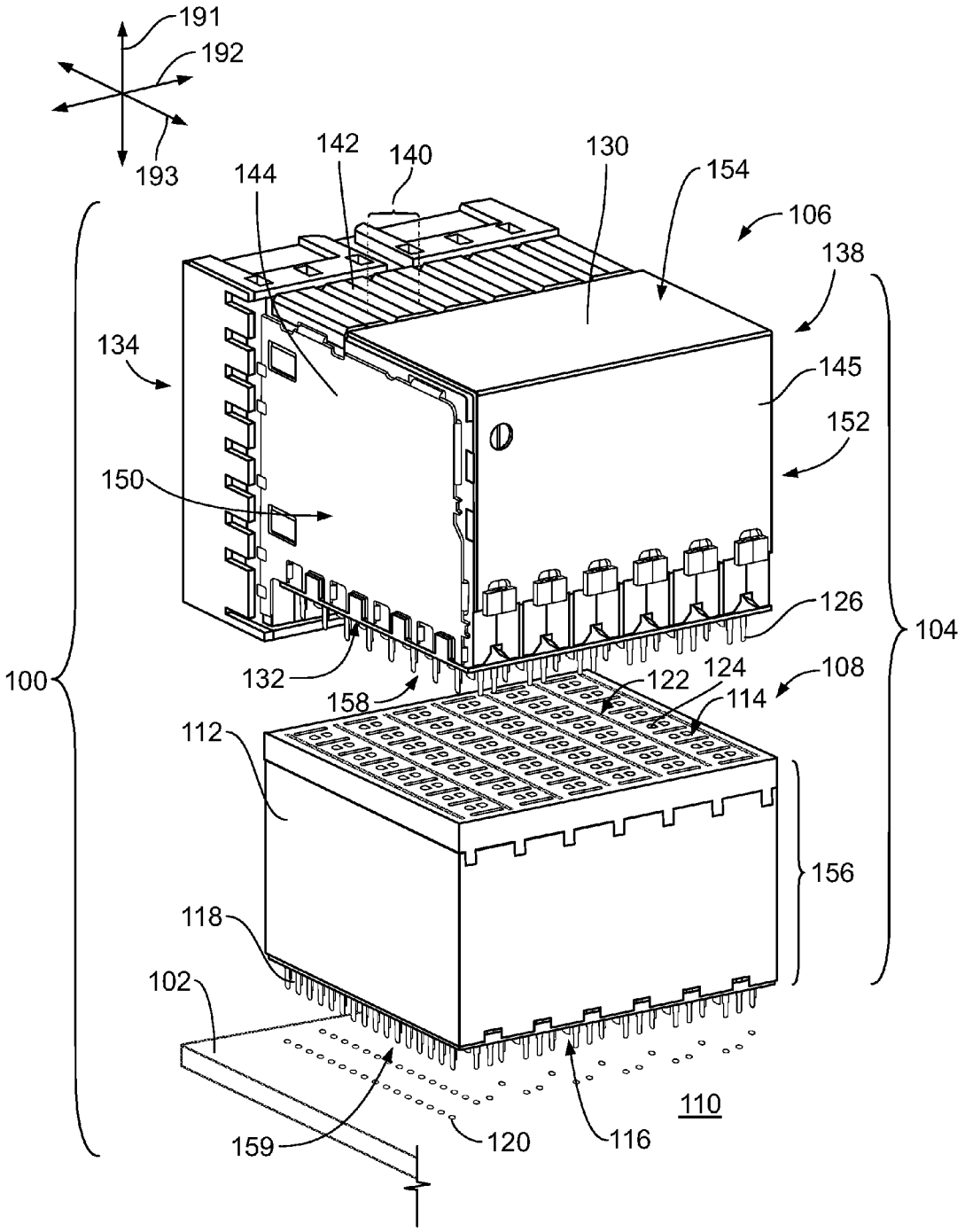
FIG. 1 is a partially exploded perspective view of a circuit board assembly in accordance with an embodiment.

Embodiments set forth herein include connector adapters and circuit board assemblies that include connector adapters. The connector adapter is configured to communicatively couple an electrical connector, such as a receptacle connector, and a circuit board, such as a daughter card. The electrical connector is configured to mate with another electrical connector, such as a header connector of a backplane or midplane communication system. The electrical connector includes signal conductors in which each signal conductor extends between a signal terminal and a signal tail (or pin) that is configured for insertion into a plated thru-hole (PTH) of a circuit board. The signal tails are typically exposed along a mounting side of the electrical connector and extend away from the mounting side. The connector adapter may include similar or identical signal terminals along a mating side of the connector adapter and similar or identical signal tails (or pins) along a mounting side of the connector adapter. The electrical connector and connector adapter may also include elements for shielding the signal conductors from one another.

In order to distinguish similar elements of the connector adapter and/or the electrical connector that are structurally similar but may have different functions, the elements may be assigned different labels in the following description and claims. For example, terminals may be labeled generally as adapter terminals or, more specifically, as signal terminals or ground terminals. More particularly, terminals may be labeled as ground fingers or pin sockets. In order to distinguish different tails, the tails may be labeled generally as connector tails or adapter tails or, more specifically, as signal tails or ground tails. However, it should be understood that elements having different labels do not necessarily have different structures. For example, signal terminals and ground terminals of the connector adapter may have structures that are identical to each other. Likewise, connector tails and adapter tails may have structures that are identical to each other. As used herein, two elements are "identical" if the elements include minor differences, such as differences due to manufacturing tolerances, that cause an undetectable or insubstantial change in function or performance.

As used herein, the phrases "a plurality of [elements]," "an array of [elements]," "an assembly of [elements]," and the like, when used in the detailed description and claims, do not necessarily include each and every element that a component, such as a connector adapter, may have. For example, the phrase "an array of signal terminals having [a recited feature]" does not necessarily mean that each and every signal terminal of the connector adapter has the recited feature. Other signal terminals of the connector adapter may not include the recited feature. Accordingly, unless explicitly stated otherwise (e.g., "each and every signal terminal of the connector adapter"), embodiments may include similar elements that do not have the recited features.

FIG. 1 is a perspective view of a partially exploded circuit board assembly 100. The circuit board assembly 100 includes a circuit board 102 and an electrical connector assembly 104. In some embodiments, the circuit board assembly 100 is a daughter card assembly that is configured to engage a backplane or midplane circuit board of a communication system. The circuit board assembly 100, however, may be used for other applications. The electrical connector assembly 104 includes an electrical connector 106 and a connector adapter 108. As shown, the circuit board assembly 100 is oriented with respect to mutually perpendicular axes 191, 192, 193, including an elevation axis 191, a lateral axis 192, and a mating axis 193. The elevation axis 191 is orthogonal or perpendicular to the circuit board 102 and may be used to measure a height or elevation of a component with respect to the circuit board 102. In FIG. 1, the elevation axis 191 appears to extend parallel to a gravitational force axis. It should be understood, however, that the circuit board assembly 100 may have any orientation with respect to gravity.

The connector adapter 108 is configured to be mounted onto a board surface 110 of the circuit board 102. The connector adapter 108 includes an adapter body 112 having a mating side 114 and a mounting side 116. In the illustrated embodiment, the mating and mounting sides 114, 116 face in opposite directions along the elevation axis 191. In other embodiments, however, the mating and mounting sides 114, 116 may have different orientations. For example, the mating side 114 may face in a direction along the mating axis 193 or the lateral axis 192. The mounting side 116 is configured to be mounted onto the board surface 110. The connector adapter 108 includes an array of adapter tails 118 that are positioned along the mounting side 116. The adapter tails 118 are configured to be mechanically and electrical coupled to electrical contacts 120 of the circuit board 102. In the illustrated embodiment, the electrical contacts 120 are plated through holes (PTHs). As such, the electrical contacts 120 will be referred to hereinafter as PTHs 120. However, it should be understood that alternative electrical contacts may be used along the circuit board 102. For example, the electrical contacts may be contact pads and the adapter tails 118 may be soldered to the contact pads. Also shown, the mating side 114 includes a cavity array 122 having cavities 124 that open to the mating side 114. Each of the cavities 124 is configured to receive a corresponding connector tail 126 of the electrical connector 106.

The electrical connector 106 includes a connector body 130 having a mounting side 132 and a mating side 134. In the illustrated embodiment, the electrical connector 106 is a right-angle electrical connector such that the mounting side 132 faces in a direction along the elevation axis 191 and the mating side 134 faces in a direction along the mating axis 193. In other embodiments, however, the electrical connector 106 may have a different configuration. For example, the electrical connector 106 may be a vertical electrical connector such that the mating side 134 and the mounting side 132 face in opposite directions along the elevation axis 191.

In some embodiments, the electrical connector 106 includes a series of contact modules 140 that are stacked side-by-side along the lateral axis 192. Each of the contact modules 140 has a module body 142 that may hold a plurality of signal conductors 146 (shown in FIG. 12) and ground conductors 148 (shown in FIG. 12). The signal conductors 146 and the ground conductors 148 may include corresponding connector tails 126. The electrical connector 106 may also include a shielding assembly 138. The shielding assembly 138 includes a plurality of ground shields 144, 145. In the illustrated embodiment, the ground shield 144 forms a connector side 150 of the electrical connector 106. The ground shield 145 is folded to extend along a back side 152 and a top side 154 of the electrical connector 106. The shielding assembly 138 may be electrically coupled to the ground conductors 148 of the electrical connector 106.

The connector adapter 108 is configured to transmit data signals between the circuit board 102 and the electrical connector 106. The connector adapter 108 is also configured to form ground paths between the electrical connector 106 and the circuit board 102 to, for example, maintain signal integrity. The connector adapter 108 is also configured to change a height or elevation of the electrical connector 106. More specifically, the connector adapter 108 has a height 156. The height 156 may be, for example, about one (1) to about five (5) centimeters (cm). In particular embodiments, the height 156 may be about one (1) cm to about three (3) cm. In some embodiments, the electrical connector 106 is a legacy connector and the connector adapter 108 permits the circuit board assembly 100 to be assembled or modified without replacing the electrical connector 106.

The connector tails 126 of the electrical connector 106 form a connector array 158, and the adapter tails 118 form an adapter array 159. In some embodiments, the adapter array 159 has a footprint that is identical to a footprint of the connector array 158. In other embodiments, the connector array 158 and the adapter array 159 do not have identical footprints.

In an exemplary embodiment, the circuit board assembly 100 is part of a communication system, such as a backplane or midplane communication system. The circuit board assembly 100 may be one daughter card assembly of a plurality of daughter card assemblies that are mounted to a backplane or midplane circuit board. The communication systems may be used in various applications. By way of example only, the communication systems may be used in telecom and computer applications, routers, servers, supercomputers, and uninterruptible power supply (UPS) systems. One or more of the electrical connectors described herein may be similar to electrical connectors of the STRADA Whisper or Z-PACK TinMan product lines developed by TE Connectivity. The electrical connectors and connector adapters may be capable of transmitting data signals at high speeds, such as 10 gigabits per second (Gb/s), 20 Gb/s, 30 Gb/s, or more. In more particular embodiments, the electrical connectors and connector adapters may be capable of transmitting data signals at 40 Gb/s, 50 Gb/s, or more. The electrical connectors and connector adapters may include high-density arrays of conductors. A high-density array may have, for example, at least 12 terminating ends per 100 mm2 along the mating side or the mounting side of the electrical connector or the connector adapter. In more particular embodiments, the high-density array may have at least 20 terminating ends per 100 mm2.

Figure 2:
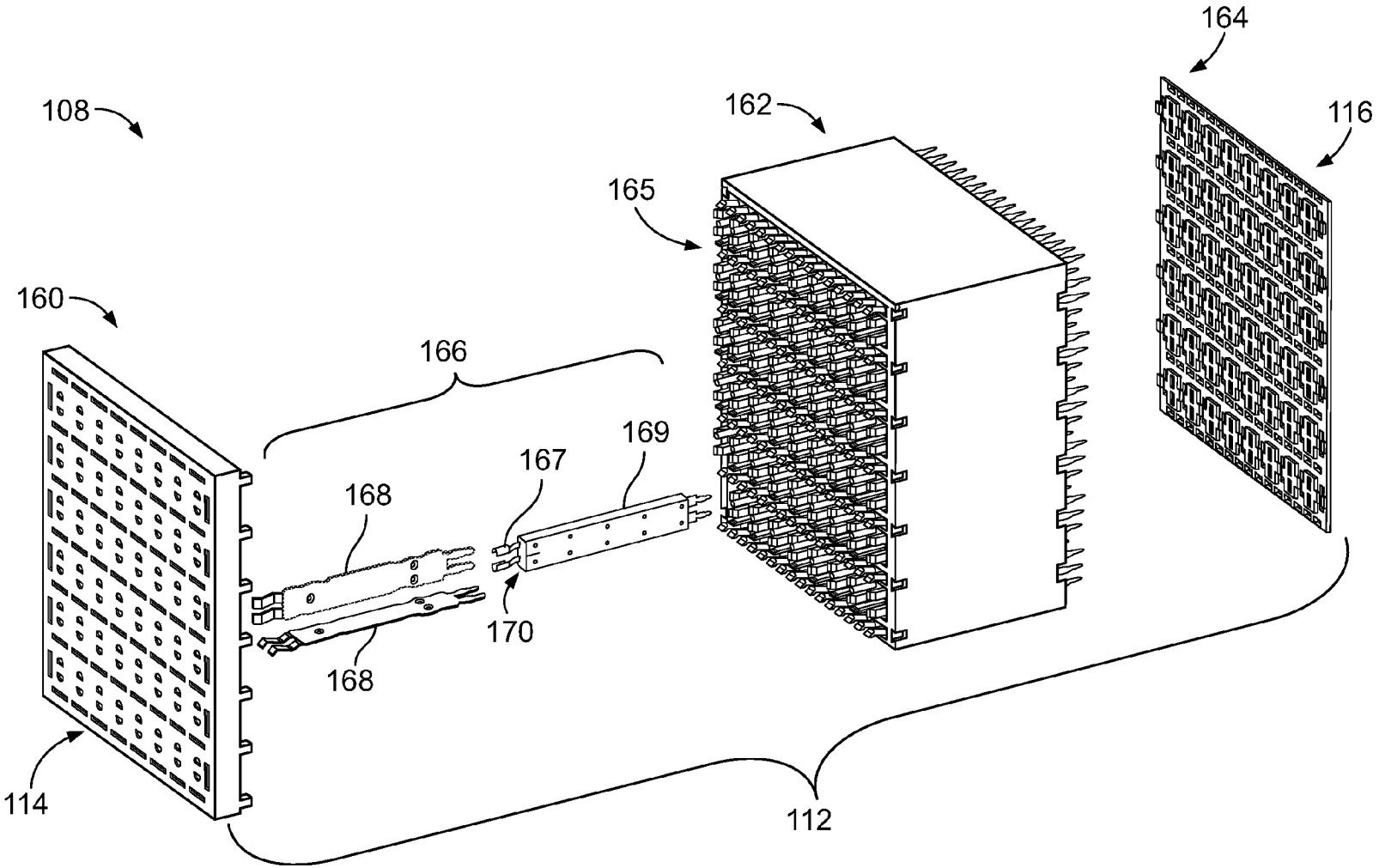
FIG. 2 is an exploded view of a connector adapter that may be used with the circuit board assembly of FIG. 1.

FIG. 2 is an exploded view of the connector adapter 108. In the illustrated embodiment, the adapter body 112 includes an adapter cover or top 160, a main housing 162, and an organizer 164 that are stacked with respect to each other along the elevation axis 191 (FIG. 1). The adapter cover 160, the main housing 162, and the organizer 164 may also be referred to as a first housing portion, a second housing portion, and a third housing portion, respectively. The adapter cover 160 includes the mating side 114 of the adapter body 112, and the organizer 164 includes the mounting side 116.

The adapter cover 160, the main housing 162, and the organizer 164 are discrete components in the illustrated embodiment that are stacked together to form the adapter body 112. In other embodiments, however, one or more of the components may be integrated with another component. For example, the adapter cover 160 and the main housing 162 may be formed as a single integrated component. In other embodiments, the adapter body 112 does not include a separate organizer 164.

The connector adapter 108 includes a conductor assembly 165 of electrical conductors 166 that are positioned within the main housing 162. The electrical conductors 166 include signal conductors 167 and ground conductors or shields 168. In the illustrated embodiment, the signal conductors 167 form signal pairs 170. Each signal pair 170 may be held within a dielectric body 169. For illustrative purposes, two of the ground conductors 168 and one of the signal pairs 170 have been removed from the main housing 162. The ground conductors 168 are configured to be positioned around each of the signal pairs 170 within the adapter body 112.

Figure 3:
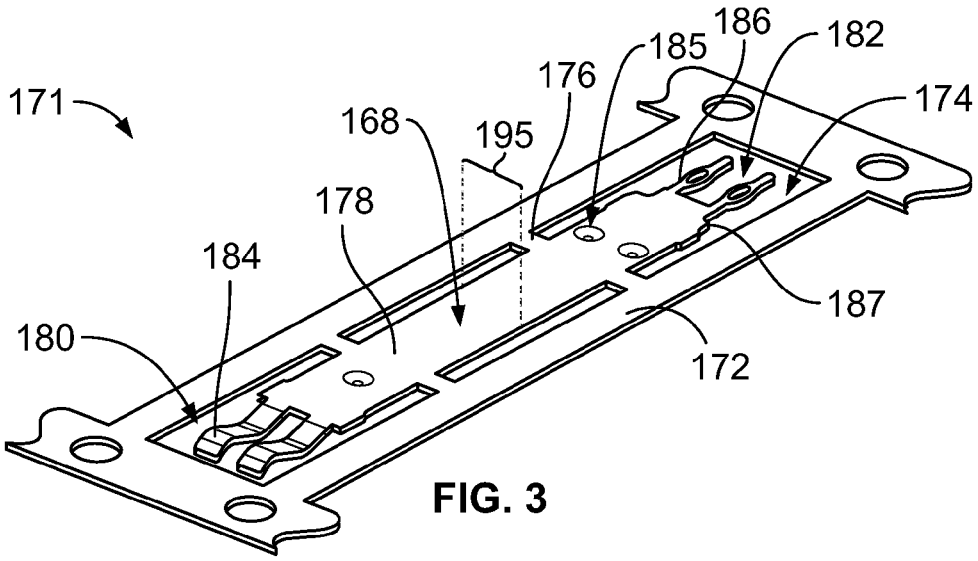
FIG. 3 is a perspective view of a lead frame holding a ground conductor that may be used with the connector adapter of FIG. 2.

FIG. 3 is a perspective view of a lead frame 171 that includes one of the ground conductors 168. The lead frame 171 may be a portion of a carrier strip that includes a plurality of the ground conductors 168. The lead frame 171 has a lattice 172 that holds the ground conductor 168 during the manufacturing of the ground conductor 168. A plurality of windows 174 define the ground conductor 168 and portions of the lattice 172. The ground conductor 168 is coupled to the lattice 172 through links 176. The lead frame 171 may be stamped to break the links 176 and thereby separate the ground conductor 168 from the lattice 172.

In the illustrated embodiment, the ground conductor 168 includes an elongated body segment 178 having opposite body ends 180, 182. A length of the body segment 178 may be determined by the designated height 156 (FIG. 1) of the connector adapter 108 (FIG. 1) such that the ground conductor 168 extends entirely through the connector adapter 108. The ground conductor 168 includes ground terminals 184 located at the body end 180 and ground tails 186 located at the body end 182. The ground tails 186 may correspond to some of the adapter tails 118 (FIG. 1). The ground terminals 184 are ground fingers that are sized and shaped to engage corresponding connector tails 126 (FIG. 1) of the electrical connector 106 (FIG. 1). The ground terminals are hereinafter referred to as ground fingers 184, but it should be understood that other structures for the terminals may be used in alternative embodiments.

The ground tails 186 are sized and shaped to be inserted into the PTHs 120 (FIG. 1) of the circuit board 102 (FIG. 1). In particular embodiments, the ground tails 186 are compliant pins that are configured to be compressed by the PTHs 120 such that the ground tails 186 are deformed. By way of example, the ground tails 186 may be press-fit pins or contacts, such as eye-of-needle (EON) pins. In some embodiments, the ground tails 186 have an identical size and shape as the connector tails 126 (FIG. 1).

As shown, the ground conductor 168 includes two ground fingers 184 and two ground tails 186. In other embodiments, however, the ground conductor 168 may include only one ground finger 184 and/or only one ground tail 186 or, alternatively, the ground conductor 168 may include more than two ground fingers 184 and/or more than two ground tails 186. Also shown, the ground conductor 168 may include projections 185, 187 along the body segment 178. The projections 185 may be bulges that are configured to engage an interior surface 248 (shown in FIG. 7) of the main housing 162 (FIG. 2). The projections 187 may be protruding edges of the body segment 178 that are also configured to engage the interior surface 248 of the main housing 162. The projections 185, 187 may facilitate securing the ground conductor 168 to the main housing 162. In addition to mechanically retaining the ground conductors 168 within the main housing 162, the projections 185 may also provide a point of electrical connection to the main housing 162 if the main housing 162 is metalized. Additional projections or other interference features could also be formed along the ground conductors 168 if additional connection points are desired.

Figure 4:
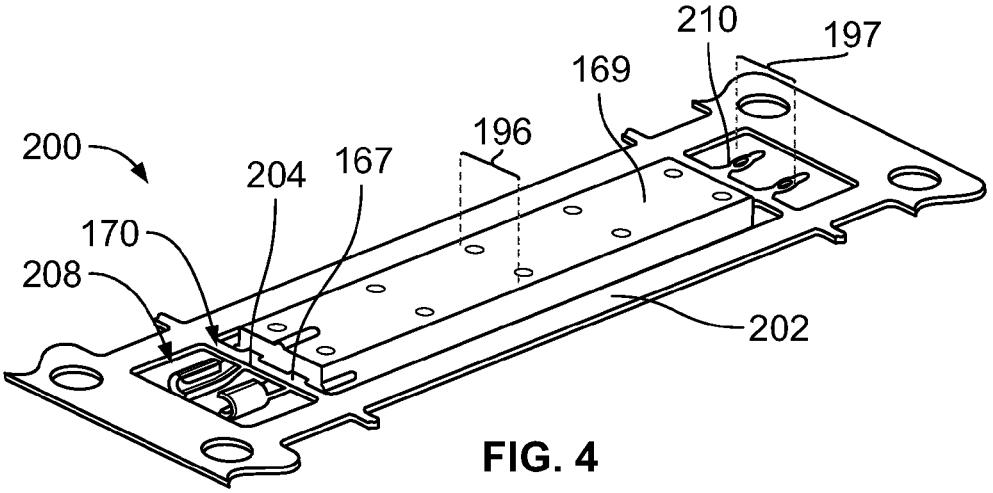
FIG. 4 is a perspective view of a lead frame holding a pair of signal conductors that may be used with the connector adapter of FIG. 2.

FIG. 4 is a perspective view of a lead frame 200 that includes a corresponding signal pair 170 of the signal conductors 167. The lead frame 200 may be similar to the lead frame 171 (FIG. 3) and, for example, be part of a larger carrier strip. The lead frame 200 includes a lattice 202 that supports the signal conductors 167. In the embodiment shown in FIG. 4, the signal conductors 167 are interconnected to each other through links 204. The links 204 may be broken to electrically separate the signal conductors 167 from each other. During the manufacture of the signal pairs 170, the dielectric body 169 may be formed around the signal pair 170 of the signal conductors 167. For example, the dielectric body 169 may be overmolded to encase portions of the signal conductors 167. However, the dielectric body 169 may be formed in other manners. For example, two dielectric shells may be mated together with the signal conductors 167 therebetween. Yet in other embodiments, a separate dielectric body is not used to surround each signal pair 170. For example, the main housing 162 may include dielectric portions or regions that surround the signal pairs 170.

Each of the signal conductors 167 includes a signal terminal 208 and a signal tail (or adapter tail) 210 located at opposite ends of the corresponding signal conductor 167. In the illustrated embodiment, the signal terminals 208 are shaped to receive a compliant pin and, as such, are hereinafter referred to as pin sockets 208. The compliant pins received by the pin sockets 208 may be some of the connector tails 126 (FIG. 1) of the electrical connector 106 (FIG. 1). The pin sockets 208 are configured to receive and engage the connector tails 126. The signal tails 210 are configured to be inserted into corresponding PTHs 120 (FIG. 1) of the circuit board 102 (FIG. 1). The signal tails 210 may be compliant pins that are configured to be compressed by the PTHs 120 such that the signal tails 210 are deformed. By way of example, the signal tails 210 may be press-fit pins or contacts, such as EON pins. In some embodiments, the signal tails 210 have an identical size and shape as the connector tails 126.

With respect to FIG. 3 and FIG. 4, in the illustrated embodiment, the ground conductors 168 (FIG. 3) are shaped to form substantially planar shields or walls in which the ground conductors 168 have a width 195 (shown in FIG. 3) that is approximately equal to a width 196 (shown in FIG. 4) of the dielectric body 169 or a width 197 (shown in FIG. 4) of the signal pair 170. As used herein, a dimension is "approximately equal" to another dimension if the smaller dimension is at most 25% less than the larger dimension (i.e., between 75% to 100% of the larger dimension). In more particular embodiments, a dimension is approximately equal to another dimension if the smaller dimension is at most 10% less than the larger dimension (i.e., between 90% to 100% of the larger dimension).

The width 195 of the ground conductors 168 is substantially greater than a width (not shown) of a single signal conductor 167 (FIG. 2). Accordingly, the ground conductors 168 are hereinafter referred to as ground blades 168. It should be understood, however, that the ground conductors may have other dimensions in other embodiments. For example, a width of a ground conductor may be about equal to a width of a signal conductor in an alternative embodiment.

Figure 5:
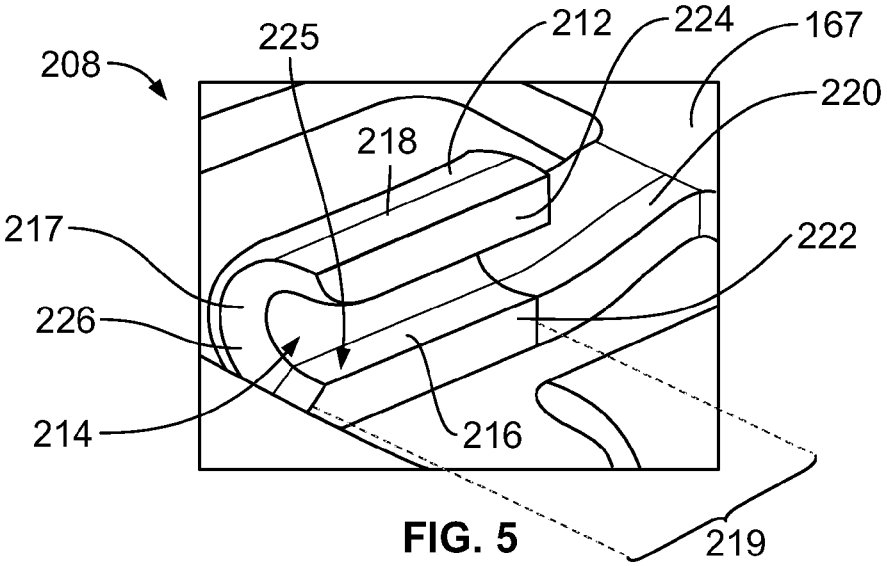
FIG. 5 is an enlarged view of a pin socket that may be used with the connector adapter of FIG. 2.

FIG. 5 is an isolated perspective view of an exemplary pin socket 208. Each of the pin sockets 208 includes a socket body 212 that is configured to mechanically and electrically engage one of the connector tails 126 (FIG. 1). In some embodiments, the socket body 212 is configured to function in a similar manner as a PTH. The socket body 212 may be shaped (e.g., rolled, bent, or folded) to form a thru-hole 214. For example, the socket body 212 includes first and second arms 216, 218 that oppose each other and define the thru-hole 214 therebetween. The thru-hole 214 extends parallel to the elevation axis 191 (FIG. 1). In the illustrated embodiment, the thru-hole 214 is open-sided along a length 219 of the socket body 212.

The first and second arms 216, 218 are coupled to each other along a center portion 217 of the socket body 212. The signal conductor 167 includes a bridge or joint 220 that couples the pin socket 208 to a body segment (not shown) of the signal conductor 167 that extends through the dielectric body 169 (FIG. 2). In the illustrated embodiment, the bridge 220 directly couples to the first arm 216. In other embodiments, the bridge 220 may directly couple to the second arm 218 or to the center portion 217.

The first and second arms 216, 218 are configured to engage the same connector tail 126 (FIG. 1) when the connector tail 126 is inserted into the thru-hole 214. The first and second arms 216, 218 have side edges 222, 224, respectively, that extend along the length 219 of the socket body 212. The side edge 222 defines a portion of the bridge 220. In the illustrated embodiment, the socket body 212 may be C-shaped or U-shaped when viewed along the elevation axis 191 (FIG. 1). However, the socket body 212 may have other shapes in alternative embodiments. For example, the socket body 212 may be nearly circular such the side edges 222, 224 of the first and second arms 216, 218, respectively, are positioned immediately adjacent to each other or are abutting each other.

The thru-hole 214 is defined by an inner surface 225 and extends along the length 219 of the socket body 212. The thru-hole 214 is dimensioned to receive the corresponding connector tail 126 (FIG. 1) such that the inner surface 225 of the socket body 212 engages the corresponding connector tail 126. In some embodiments, the socket body 212 has a thickness that resists deformation when the connector tail 126 is inserted into the thru-hole 214. In other embodiments, however, the socket body 212 has a thickness that is configured to deform when the connector tail 126 is inserted into the thru-hole 214. For example, the socket body 212 may expand such that the thru-hole 214 increases in size. Also shown in FIG. 5, the socket body 212 includes a receiving edge 226. The receiving edge 226 may engage the connector tail 126. In some embodiments, the receiving edge 226 may be beveled or chamfered to facilitate aligning the connector tail 126 with the thru-hole 214.

Although the signal terminals are illustrated and described herein as pin sockets, it should be understood that the signal terminals may have other structures or configurations in alternative embodiments. For example, the signal terminal may comprise a contact beam that is deflected by the connector tail 126 and slides along a side of the connector tail 126 during a mounting or stacking operation. In such embodiments, the connector tail 126 may not be compressed by the signal terminal.

Figure 6:
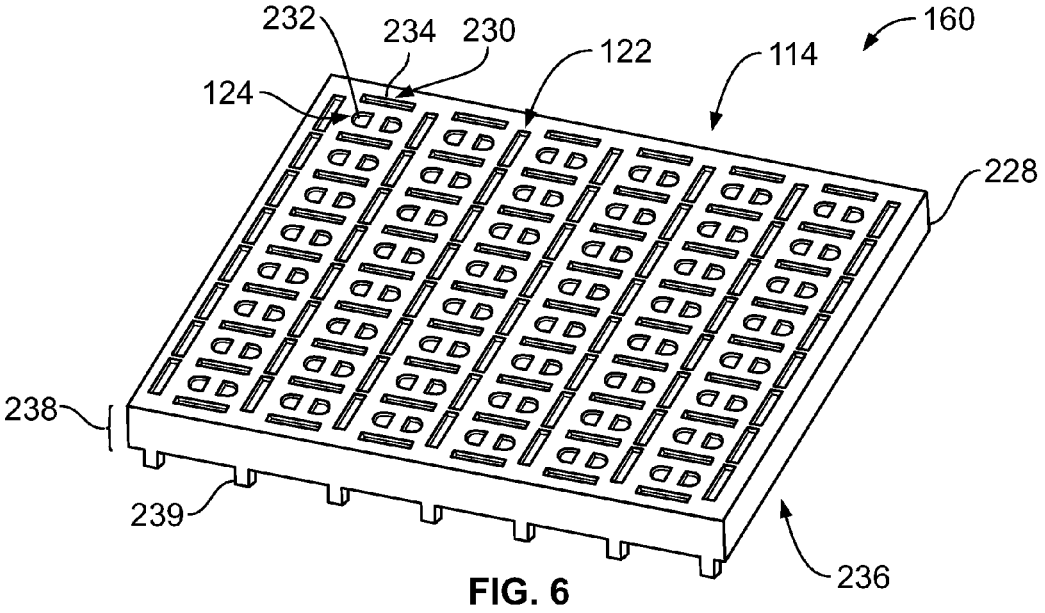
FIG. 6 is a perspective view of an adapter cover that may be used with the connector adapter of FIG. 2.

FIG. 6 is an isolated perspective view of the adapter cover 160. The adapter cover 160 may also be referred to as an upper housing, because the adapter cover 160 is located furthest away from the circuit board 102 (FIG. 1). The adapter cover 160 comprises a dielectric body 228 that may be shaped (e.g., molded) to include the cavity array 122. The cavities 124 include signal cavities 232 and ground cavities 234. The signal cavities 232 are configured to align with and receive portions of the signal conductors 167 (FIG. 2) and corresponding connector tails 126 (FIG. 1). The ground cavities 234 are configured to align with and receive portions of the ground blades 168 (FIG. 2) and corresponding connector tails 126. The signal and ground cavities 232, 234 may form cavity sub-arrays 230 in which each cavity sub-array 230 includes two of the signal cavities 232 and a plurality of the ground cavities 234.

The adapter cover 160 is configured to facilitate aligning the connector tails 126 (FIG. 1) with the corresponding signal conductors 167 (FIG. 2) or ground blades 168 (FIG. 2). In some embodiments, the adapter cover 160 may also facilitate retaining the signal conductors 167 and the ground blades 168 within the connector adapter 108 (FIG. 1). For example, the adapter cover 160 may form an interference fit with portions of the signal conductors 167 and the ground blades 168.

The adapter cover 160 includes the mating side 114 of the connector adapter 108 (FIG. 1) and a housing side 236. The mating side 114 and the housing side 236 face in opposite directions. The housing side 236 is configured to directly engage the main housing 162 (FIG. 2). A thickness 238 of the adapter cover 160 is defined between the mating side 114 and the housing side 236. In some embodiments, the adapter cover 160 includes coupling projections 239 that are positioned along the housing side 236.

Figure 7:
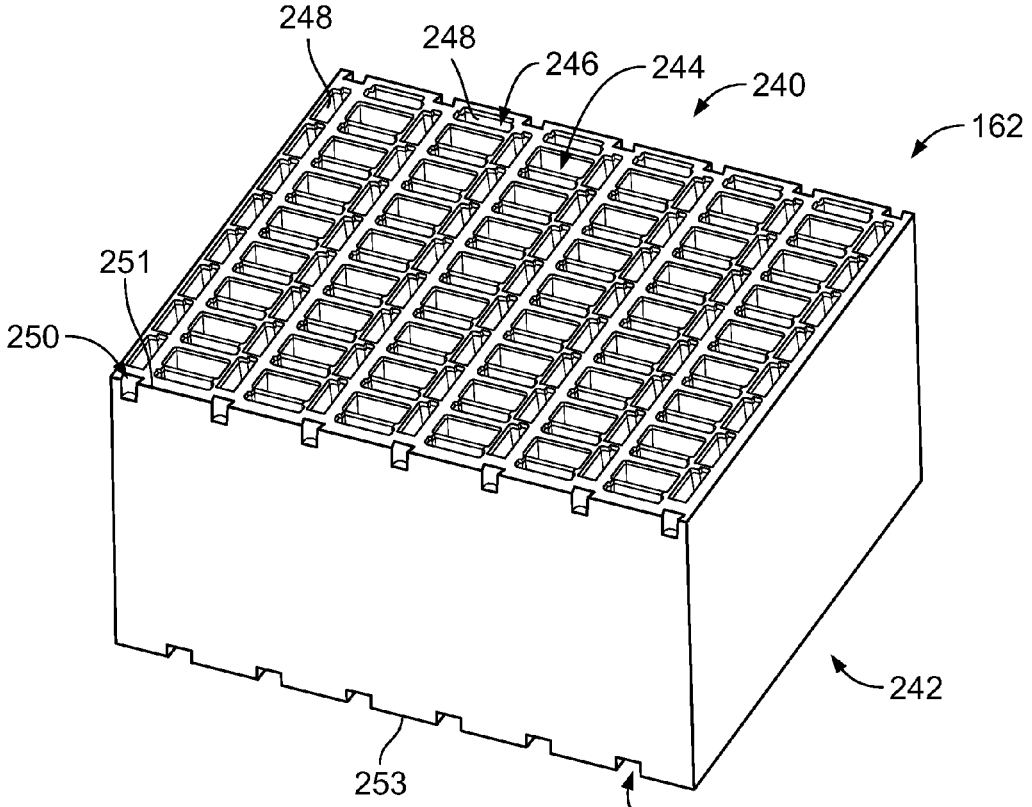
FIG. 7 is a perspective view of a main housing that may be used with the connector adapter of FIG. 2.

FIG. 7 is an isolated perspective view of the main housing 162. The main housing 162 includes a first body side 240 and a second body side 242 that are configured to face in opposite directions along the elevation axis 191 (FIG. 1). The first body side 240 is configured to couple to the adapter cover 160 (FIG. 2). The second body side 242 is configured to couple to the organizer 164 (FIG. 2). As shown in FIG. 7, the main housing 162 includes an array of conductor channels 244, 246 that extend through the main housing 162 between the first body side 240 and the second body side 242. At least some known electrical connectors include a plurality of chiclets (or lead frames) that are positioned side-by-side and coupled to each other. Each chiclet may define one column of signal conductors. Collectively, the chiclets include all of the signal conductors of the electrical connector. In the illustrated embodiment, however, the main housing 162 is configured to surround all of the signal conductors 167 (FIG. 2) and ground blades 168 (FIG. 2) (or the entire conductor assembly 165 (FIG. 2)). The conductor channels 244 are configured to receive the signal conductors 167 (FIG. 2) and, as such, are hereinafter referred to as signal channels 244. In the illustrated embodiment, each signal channel 244 is sized and shaped to receive the dielectric body 169 (FIG. 2) of the signal pair 170 (FIG. 2) such that two of the signal conductors 167 extend through a single signal channel 244.

The conductor channels 246 are configured to receive the ground blades 168 (FIG. 2) and, as such, are hereinafter referred to as the ground channels 246. The ground channels 246 are defined by interior surfaces 248. In the illustrated embodiment, each conductor channel 246 is sized and shaped to receive a single ground blade 168. The signal and ground channels 244, 246 are positioned to align with the signal and ground cavities 232, 234 (FIG. 6), respectively, when the adapter cover 160 (FIG. 2) is stacked upon the first body side 240.

Also shown in FIG. 7, the main housing 162 includes a plurality of recesses 250 along the first body side 240 and a plurality of recesses 252 along the second body side 242. The recesses 250, 252 may be positioned along respective corners 251, 253 of the main housing 162. The recesses 250 are sized and shaped to receive the coupling projections 239 (FIG. 6) of the adapter cover 160 (FIG. 2). The coupling projections 239 may form an interference fit with the main housing 162. In an exemplary embodiment, the coupling projections 239 and the recesses 250 have a complementary dovetail shape.

In some embodiments, the main housing 162 may be conductive to facilitate electrically separating the signal pairs 170 (FIG. 2). For example, the main housing 162 may be metalized for electrically commoning the ground blades 168 (FIG. 2). To this end, the main housing 162 may comprise a dielectric material that includes conductive particles, a dielectric material having surfaces that are plated with metal, and/or one or more portions that are die cast from metal. The main housing 162 may also be machined from metal or sintered (e.g., direct metal laser sintering (DMLS)). In particular embodiments, the interior surfaces 248 that define the conductor channels 246 are plated with metal to electrically couple to the ground blades 168.

Figure 8:
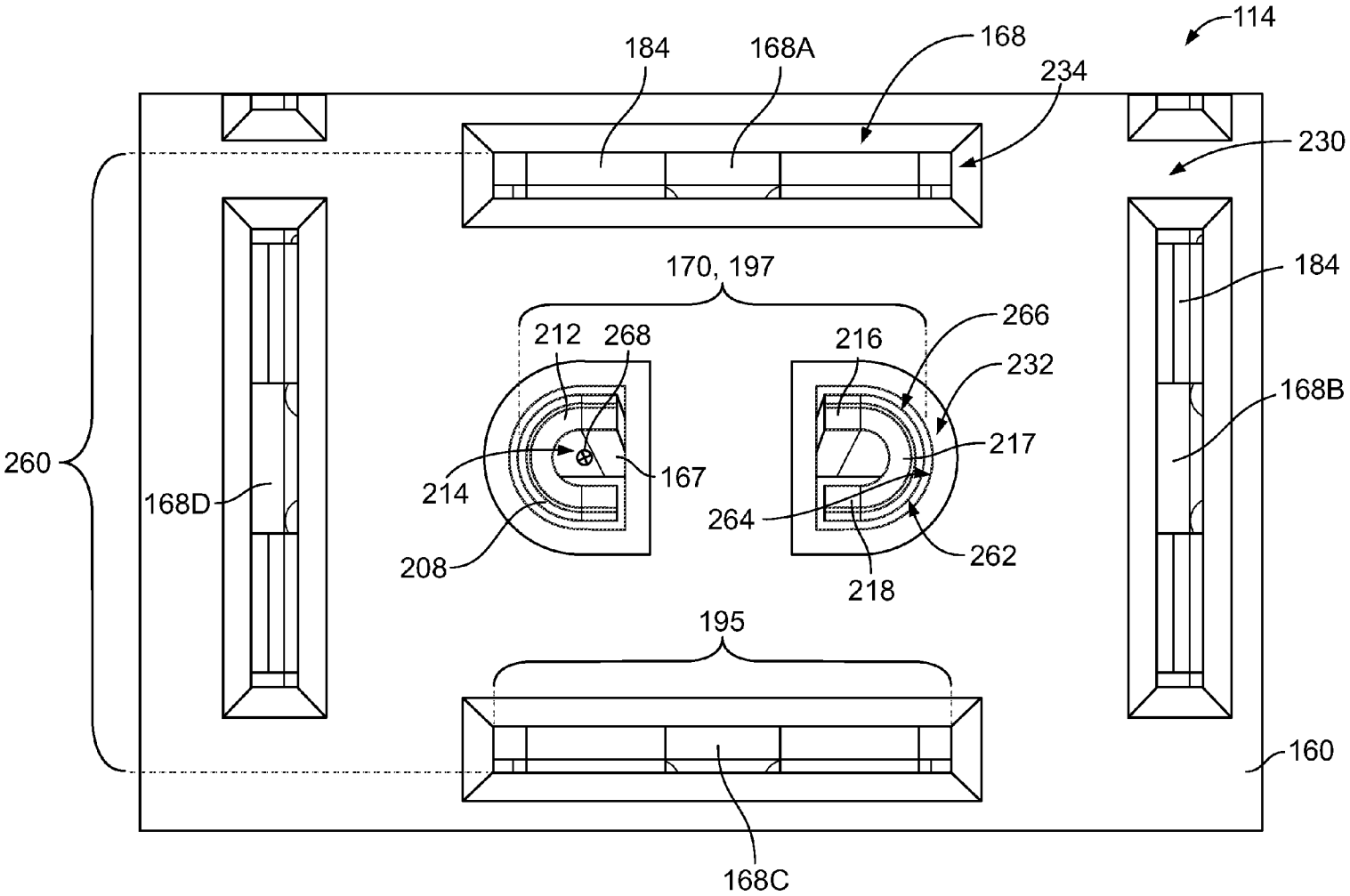
FIG. 8 is a plan view of a conductor sub-assembly along a mating side of the connector adapter of FIG. 2.

FIG. 8 is a plan view of an enlarged portion of the mating side 114. More specifically, FIG. 8 illustrates an exemplary cavity sub-array 230 that is aligned with one conductor sub-assembly 260. The conductor sub-assembly 260 includes one signal pair 170 of the signal conductors 167 and four ground blades 168 that surround the signal pair 170. The signal conductors 167 are aligned with the signal cavities 232 and the ground blades 168 are aligned with the ground cavities 234. More specifically, the pin sockets 208 are positioned within the signal cavities 232 and configured to receive the corresponding connector tails 126 (FIG. 1), and the ground fingers 184 are positioned within the ground cavities 234 and configured to engage the corresponding connector tails 126.

Each signal pair 170 may be electrically separated from adjacent signal pairs 170 by the ground blades 168. For example, each signal pair 170 may be surrounded by at least two of the ground blades 168. In the illustrated embodiment, the conductor sub-assembly 260 includes ground blades 168A, 168B, 168C, 168D. Each of the ground blades 168A-168D effectively forms a ground shield or wall that electrically separates the signal pair 170 from other signal pairs. More specifically, the ground blades 168A, 168C oppose each other with the signal pair 170 therebetween, and the ground blades 168B, 168D oppose each other with the signal pair 170 therebetween. The ground blades 168A-168D are positioned to surround the corresponding signal pair 170. As shown, the width 195 of the ground blades 168A-168D is greater than the width 197 of the signal pair 170.

In an exemplary embodiment, two or more of the ground blades 168 are shared by other conductor sub-assemblies 260. For example, the ground blade 168A may be positioned between the signal pair 170 and an adjacent signal pair (not shown). In such embodiments, two conductor sub-assemblies 260 may include the same ground blade 168A.

In the illustrated embodiment, each of the ground blades 168 is oriented perpendicular to adjacent ground blades of the same conductor sub-assembly 260. For example, the ground blade 168A is oriented perpendicular to the ground blade 168B and the ground blade 168D. The ground blade 168C is oriented perpendicular to the ground blade 168B and the ground blade 168C. The ground blades 168A, 168C are oriented parallel to each other, and the ground blades 168B, 168D are oriented parallel to each other.

In alternative embodiments, other configurations of ground conductors may be used. For example, a C-shaped ground conductor may replace the ground blades 168D, 168A, 168B in the conductor sub-assembly 260, or an L-shaped ground conductor may replace the ground blades 168A, 168B in the conductor sub-assembly 260. In such embodiments, the C-shaped ground conductor would substitute for three individual ground blades, and the L-shaped ground conductor would substitute for two individual ground blades.

As shown in FIG. 8, each of the pin sockets 208 includes an outer surface 262 that faces an interior surface 264 of the adapter cover 160. The interior surface 264 is a dielectric surface. The outer surface 262 extends along the first and second arms 216, 218 and the center portion 217. The interior surface 264 may define the corresponding signal cavity 232. As shown in FIG. 8, the outer surface 262 and the interior surface 264 have a similar shape and are separated from each other by an expansion gap 266. In some embodiments, the pin sockets 208 may expand when engaging the corresponding connector tail 126 such that the expansion gap 266 decreases and/or the outer surface 262 presses against the interior surface 264.

The signal conductors 167 may extend along a conductor axis 268 that extends parallel to the elevation axis 191 (FIG. 1). The conductor axis 268 is a straight line. In some embodiments, the pin socket 208 and the signal tail 210 of each signal conductor 167 are aligned along the conductor axis 268 such that the conductor axis 268 intersects the pin socket 208 and the signal tail 210 (FIG. 4) of the corresponding signal conductor 167. As set forth herein, the conductor axis 268 intersects the pin socket 208 if the conductor axis 268 extends through the socket body 212 or through the thru-hole 214. In particular embodiments, the signal conductors 167 are linear such that the conductor axis 268 coincides with the signal conductor 167.

Figure 9:
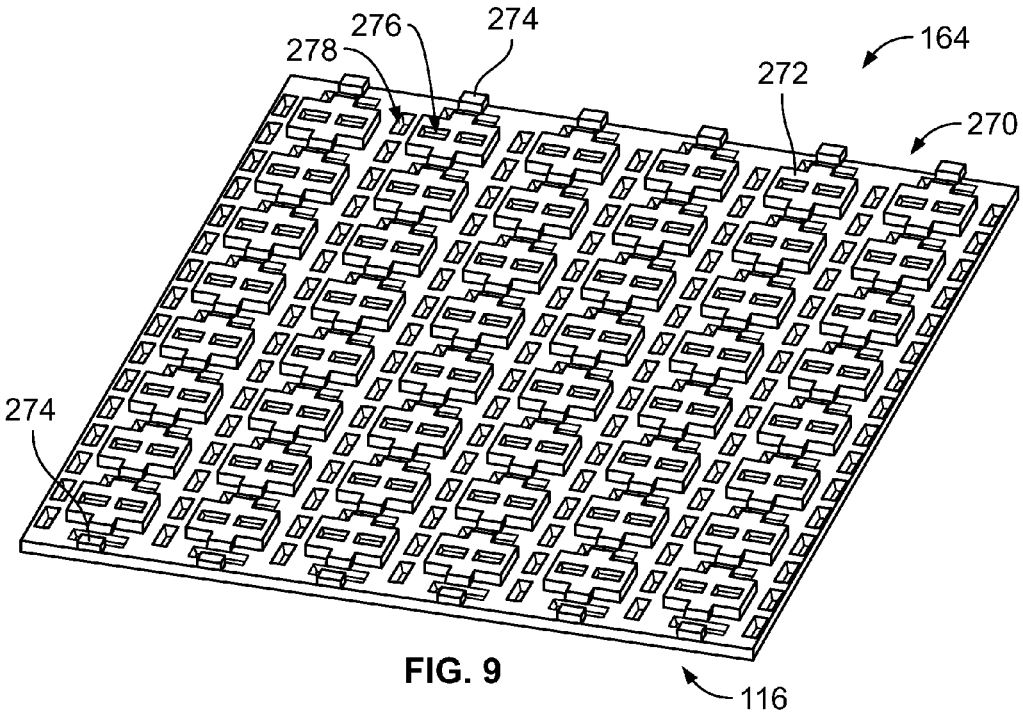
FIG. 9 is a perspective view of an organizer that may be used with the connector adapter of FIG. 2.

FIG. 9 is an isolated perspective view of the organizer 164. The organizer 164 includes the mounting side 116 and an opposite housing side 270 that is configured to couple to the second body side 242 (FIG. 7) of the main housing 162 (FIG. 2). As shown, the housing side 270 includes an array of channel projections 272. The channel projections 272 are sized and shaped relative to the cross-sectional dimensions of the signal channels 244 (FIG. 7) such that each of the channel projections 272 is at least partially inserted into a corresponding signal channel 244 and forms an interference fit with the main housing 162. Also shown in FIG. 9, the housing side 270 may include a plurality of coupling projections 274. The coupling projections 274 are configured to be inserted into the recesses 252 (FIG. 7) and form an interference lit with the main housing 162 (FIG. 7). The organizer 164 also includes signal cavities 276 that are configured to receive the signal tails 210 (FIG. 4) and ground cavities 278 that are configured to receive the ground tails 186 (FIG. 3). The signal cavities 276 are formed through the channel projections 272.

Figure 10:
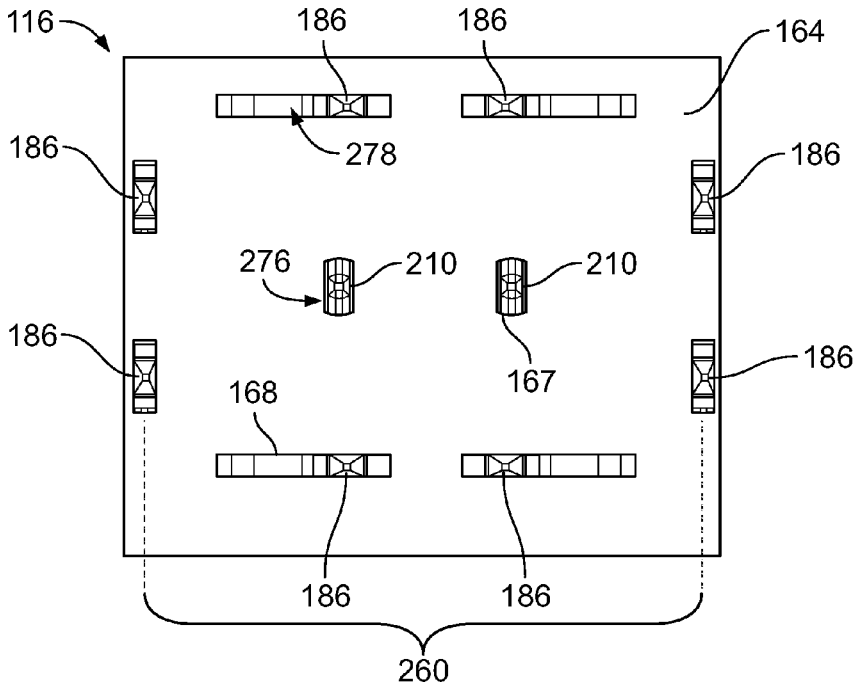
FIG. 10 is a plan view of the conductor sub-assembly along a mounting side of the connector adapter of FIG. 2.

FIG. 10 is a plan view of a portion of the mounting side 116. In particular, FIG. 10 shows the signal and ground tails 210, 186 of a conductor sub-assembly 260. As shown, the ground tails 186 are positioned to surround the signal tails 210. In some embodiments, the signal and ground cavities 276, 278 are dimensioned to form a snug fit with portions of the signal conductor 167 and the ground blade 168, respectively, such as the signal and ground tails 210, 186, respectively. The organizer 164 may mechanically support the signal and ground tails 210, 186 and prevent unintended deformation of the signal and ground tails 210, 186 when the connector adapter 108 (FIG. 1) is mounted to the circuit board 102 (FIG. 1).

Figure 11:
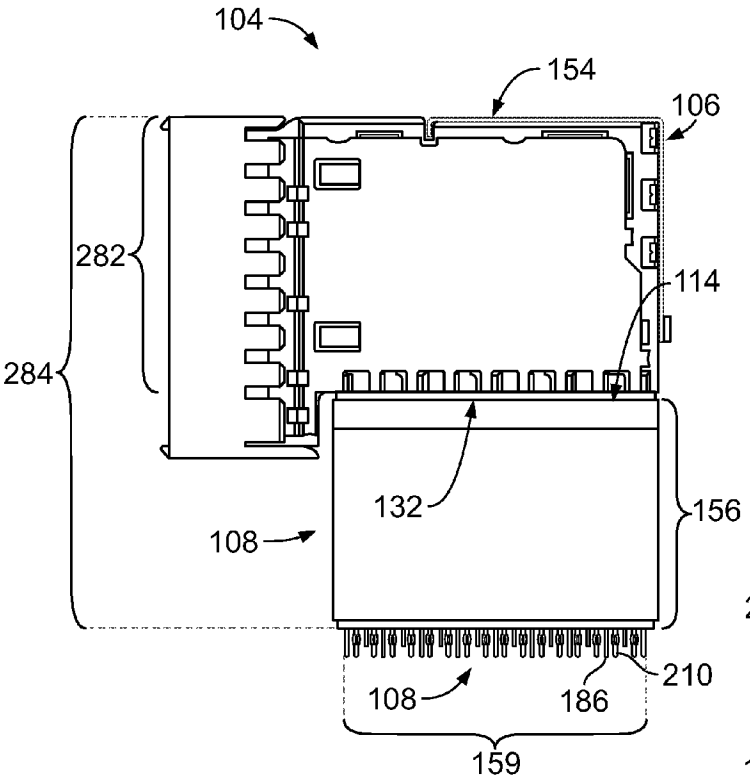
FIG. 11 is a side view of an electrical connector assembly that may be used with the circuit board assembly of FIG. 1.

FIG. 11 is a side view of the electrical connector assembly 104. As shown, the electrical connector 106 has been stacked onto the connector adapter 108 such that the mounting side 132 of the electrical connector 106 interfaces with the mating side 114 of the connector adapter 108. The electrical connector 106 has a connector height 282 that is measured between the top side 154 and the mounting side 132. The electrical connector assembly 104 has an assembly height 284 that is measured between the top side 154 of the electrical connector 106 and the mounting side 116 of the connector adapter 108. Thus, the connector adapter 108 has effectively increased a height of the electrical connector 106 by the height 156 of the connector adapter 108.

Also shown in FIG. 11, the signal and ground tails 210, 186 project from the mounting side 116. The signal and ground tails 210, 186 form the adapter array 159. In particular embodiments, the adapter array 159 has a footprint along the mounting side 116 that is identical to a footprint formed by the connector tails 126 (FIG. 1) of the connector array 158 (FIG. 1). In other words, the cavity array 122 (FIG. 1) may be capable of receiving a connector array 158 that is identical to the adapter array 159. In such embodiments, the circuit board assembly 100 (FIG. 1) may be modified to change an elevation of the electrical connector 106 without replacing the electrical connector 106 or the circuit board 102 (FIG. 1).

Figure 12:
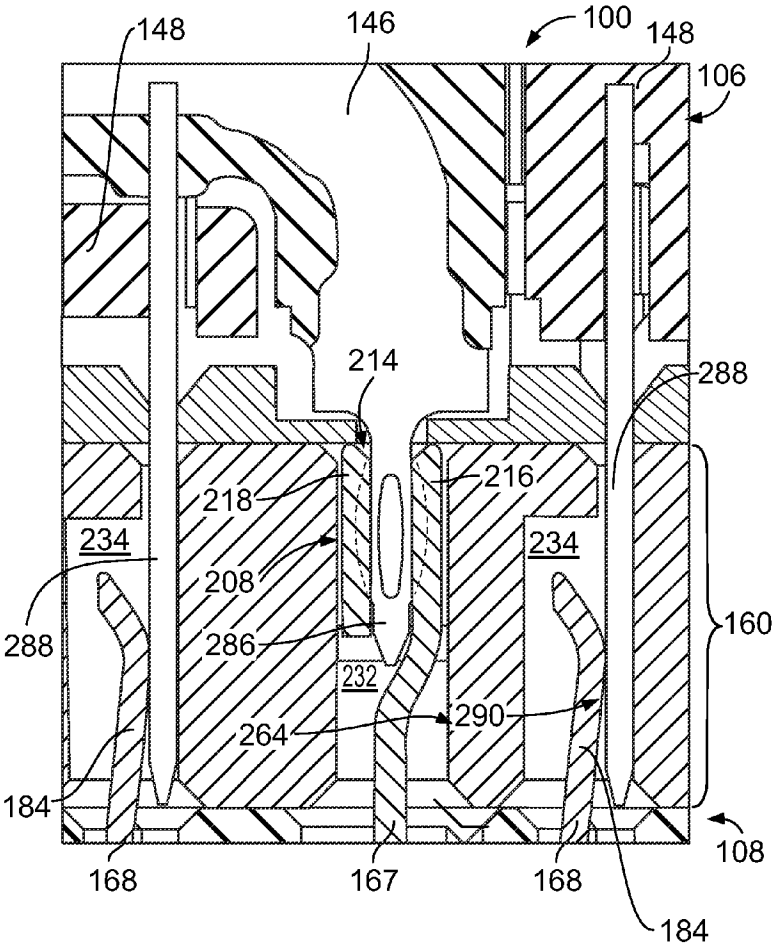
FIG. 12 is an enlarged cross-section of a portion of the circuit board assembly of FIG. 1.

FIG. 12 is a cross-section of the circuit board assembly 100 illustrating an exemplary signal conductor 146 and exemplary ground conductors 148 of the electrical connector 106. The signal conductor 146 includes a compliant tail 286, which represents one of the connector tails 126 in FIG. 1. The ground conductors 148 are electrically coupled to ground pins 288, which represent other connector tails 126 in FIG. 1. As shown in FIG. 12, the ground pins 288 are inserted into corresponding ground cavities 234 and engaged with ground fingers 184 of the corresponding ground blades 168. During a mounting or stacking operation in which the electrical connector 106 is stacked onto the connector adapter 108, the ground pins 288 are advanced into the corresponding ground cavities 234 and engage and deflect the corresponding ground fingers 184. The ground fingers 184 are configured to provide a biasing force 290 that presses the ground fingers 184 against the corresponding ground pins 288 while the ground pins 288 are operably positioned within the ground cavities 234.

The ground pins 288 are configured to engage the adapter cover 160 prior to the compliant tails 286. As the ground pins 288 engage the adapter cover 160, the electrical connector 106 may become aligned with the connector adapter 108 so that the compliant tails 286 may be inserted into the thru-holes 214 with less stubbing. As the compliant tail 286 advances into the corresponding thru-hole 214, the compliant tail 286 may deflect the first and second arms 216, 218 away from each other. In some embodiments, the first and second arms 216, 218 may be deflected into engagement with the interior surface 264 of the adapter cover 160 such that the first and second arms 216, 218 are prevented from expanding further. In such embodiments, the pin socket 208 may function similarly to a PTH and a tighter fit between the compliant tails 286 and the pin sockets 208 may be achieved.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. In addition, in the following claims, the term "plurality" does not include each and every element that an object may have. Further, the limitations of the following claims are not written in means plus-function format and are not intended to be interpreted based on 35 U.S.C. §112 (f) unless and until such claim limitations expressly use the phrase "means for" followed by a statement of function void of further structure.

What is claimed is:

1. A connector adapter comprising:

an adapter body having a mating side and a mounting side, the mounting side configured to be mounted to a circuit board, the mating side configured to have an electrical connector stacked thereon, the mating side including signal cavities that open to the mating side; and signal conductors extending through the adapter body, each of the signal conductors having and extending between a pin socket positioned at the mating side and a signal tail positioned at the mounting side, the pin sockets being positioned within corresponding signal cavities, each of the pin sockets comprising a socket body having a receiving edge and an inner surface that extend continuously around a conductor axis and to define a thru-hole, the receiving edge being closer to the mating side than the inner surface, the inner surface extending from the receiving edge and along the conductor axis, wherein the receiving edge and the inner surface of the socket body are configured to engage and compress opposite edges of a connector tail of the electrical connector as the connector tail of the electrical connector is inserted into the thru-hole in a direction along the conductor axis.

2. The connector adapter of claim 1, wherein the socket body includes first and second arms and a center portion that joins the first and second arms, the first and second arms opposing each other with the thru-hole therebetween, the inner surface extending continuously along the first arm, the center portion, and the second arm to define the thru-hole, the receiving edge extending continuously along the first arm, the center portion, and the second arm and coinciding with a plane that is perpendicular to the conductor axis.

3. The connector adapter of claim 1, wherein each of the signal cavities is defined by a corresponding interior surface of the adapter body, the corresponding interior surface being shaped such that an expansion gap exists between the corresponding interior surface and the corresponding socket body, the socket body of each pin socket forming first and second arms that oppose each other with the thru-hole therebetween, wherein the expansion gap and the first and second arms are configured relative to each other such that the first and second arms are deflected into engagement with the interior surface that defines the corresponding signal cavity when the connector tail of the electrical connector is inserted into the thru-hole of the corresponding pin socket and engages the first and second arms.

4. The connector adapter of claim 1, wherein the mating side includes ground cavities that open to the mating side and the connector adapter further comprises ground blades that extend through the adapter body, the signal conductors forming a plurality of signal pairs, the ground blades being positioned such that each of the signal pairs is surrounded by corresponding ground blades, wherein at least two of the corresponding ground blades are oriented perpendicular to each other, the ground blades having ground terminals that are positioned within the ground cavities, wherein each of the ground terminals is configured to engage a corresponding ground tail of the electrical connector when the electrical connector is stacked onto the mating side.

5. The connector adapter of claim 1, wherein the mating side and the mounting side face in opposite directions along an elevation axis, the pin socket and the signal tail of each signal conductor being aligned along the conductor axis that extends parallel to the elevation axis.

6. The connector adapter of claim 1, wherein the socket body has two side edges that extend parallel to the conductor axis for an entire length of the socket body, the inner surface and the receiving edge extending continuously around the conductor axis such that the thru-hole is open along only one side of the socket body and open at opposite ends of the thru-hole.

7. The connector adapter of claim 1, wherein the receiving edge is C-shaped or U-shaped, the receiving edge positioned to engage the connector tail prior to other elements, including the inner surface, of the socket body engaging the connector tail.

8. An electrical connector assembly comprising:

an electrical connector having a mounting side and a connector array of signal and ground tails positioned along the mounting side, the electrical connector having a mating side that is configured to mate with an electrical component, wherein the signal and ground tails of the electrical connector include press-fit pins that are configured to be compressed and deformed; and a connector adapter including an adapter body having a mating side that is configured to interface with the mounting side of the electrical connector, the mating side including signal and ground cavities that open to the mating side, the connector adapter including a conductor assembly having signal and ground conductors that extend through the adapter body, the signal conductors forming a plurality of signal pairs, the ground conductors being positioned such that each of the signal pairs is surrounded by at least two of the ground conductors, the signal and ground conductors having signal and ground terminals, respectively, that are positioned within the signal and ground cavities, respectively, proximate to the mating side, wherein the signal and ground terminals engage the signal and ground tails, respectively, of the connector array;

wherein the signal and ground conductors of the conductor assembly have signal and ground tails that form an adapter array at a mounting side of the adapter body, wherein the signal and ground tails of the adapter array and the signal and ground tails, respectively, of the connector array have identical positions relative to the respective mounting side.

9. The electrical connector assembly of claim 8, wherein the signal terminals of the signal conductors include pin sockets, each of the pin sockets comprising a socket body that is shaped to extend around a conductor axis and define a thru-hole that extends lengthwise along the conductor axis, the socket body configured to engage the corresponding signal tail of the electrical connector when the corresponding signal tail is inserted into the thru-hole in a direction along the conductor axis.

10. The electrical connector assembly of claim 8, wherein the adapter body includes a main housing having ground conductor channels that receive the ground conductors and signal conductor channels that receive the signal pairs, the main housing being metalized to electrically common the ground conductors, the signal pairs being held within respective dielectric bodies that are positioned within the signal conductor channels.

11. The electrical connector assembly of claim 8, wherein the electrical connector is a right-angle connector.

12. The electrical connector assembly of claim 8, wherein each of the signal conductors has a pin socket positioned within a corresponding signal cavity, the pin socket including first and second arms that oppose each other and define a thru-hole therebetween, wherein each of the signal cavities is defined by a corresponding interior surface of the adapter body, the corresponding interior surface being shaped such that an expansion gap exists between the corresponding interior surface and the first and second arms, wherein the interior surface and the first and second arms are configured relative to each other such that the first and second arms are deflected into engagement with the interior surface that defines the corresponding signal cavity when the connector tail of the electrical connector is inserted into the thru-hole of the corresponding pin socket and engages the first and second arms.

13. The electrical connector assembly of claim 8, wherein the signal terminals of the signal conductors include pin sockets, each of the pin sockets including a socket body having a receiving edge and an inner surface that each extend continuously around a conductor axis and define a thru-hole, the receiving edge being closer to the mating side than the inner surface, the inner surface extending from the receiving edge and along the conductor axis, wherein the receiving edge and the inner surface of the socket body are configured to engage and compress opposite edges of a corresponding signal tail of the electrical connector as the signal corresponding tail of the electrical connector is inserted into the thru-hole in a direction along the conductor axis.

14. A daughter card assembly configured to engage a backplane or midplane circuit board of a communication system, the daughter card assembly comprising:

a right-angle electrical connector having a mounting side and a connector array of signal and ground tails positioned along the mounting side, the electrical connector having a mating side that is configured to mate with an electrical connector of the communication system, the mating and mounting sides facing in perpendicular directions;

a circuit board having electrical contacts; and a connector adapter stacked between and communicatively coupling the electrical connector and the circuit board, the connector adapter increasing an elevation of the mating side of the electrical connector relative to the circuit board, the connector adapter including an adapter body having a mating side that interfaces with the mounting side of the electrical connector, the mating side including signal and ground cavities that open to the mating side, the connector adapter including a conductor assembly having signal and ground conductors that extend through the adapter body, the signal conductors forming a plurality of signal pairs, the ground conductors being positioned to electrically separate the signal pairs, the signal and ground conductors having signal and ground terminals, respectively, that are positioned within the signal and ground cavities, respectively, proximate to the mating side, wherein the signal and ground terminals engage the signal and ground tails, respectively, of the connector array and wherein the electrical connector, the connector adapter, and the circuit board are coupled to one another such that the daughter card assembly is movable as a unit for mating with the communication system, and wherein the signal and ground conductors of the conductor assembly have signal and ground tails that form an adapter array at a mounting side of the adapter body, wherein the adapter array and the connector array are identical.

15. The daughter card assembly of claim 14, wherein the signal terminals of the signal conductors include pin sockets, each of the pin sockets comprising a socket body that is shaped to extend around a conductor axis and define a thru-hole that extends lengthwise along the conductor axis, the socket body configured to engage the corresponding signal tail of the electrical connector when the corresponding signal tail is inserted into the thru-hole in a direction along the conductor axis.

16. The daughter card assembly of claim 14, wherein the adapter body includes a main housing having ground conductor channels that receive the ground conductors and signal conductor channels that receive the signal pairs, the main housing being metalized to electrically common the ground conductors, the signal pairs being held within respective dielectric bodies that are positioned within the signal conductor channels.

17. The daughter card assembly of claim 14, wherein the mating side of the electrical connector clears a leading edge of the circuit board such that the mating side is located in front of the leading edge.

18. The daughter card assembly of claim 14, wherein the electrical connector includes a series of contact modules that are stacked side-by-side along a lateral axis that is parallel to the circuit board, each of the contact modules including a plurality of signal conductors of the electrical connector.

19. The daughter card assembly of claim 14, wherein the signal and ground tails of the electrical connector include press-fit pins that are configured to be compressed and deformed.

* * * * *